US012247467B2

(12) United States Patent
MacGillivray et al.

(10) Patent No.: US 12,247,467 B2
(45) Date of Patent: Mar. 11, 2025

(54) SLEEVED GUN CONNECTION

(71) Applicant: Halliburton Energy Services, Inc., Houston, TX (US)

(72) Inventors: Joseph T. MacGillivray, Fort Worth, TX (US); Christopher C. Hoelscher, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 82 days.

(21) Appl. No.: 17/423,366

(22) PCT Filed: Mar. 29, 2019

(86) PCT No.: PCT/US2019/024969
§ 371 (c)(1),
(2) Date: Jul. 15, 2021

(87) PCT Pub. No.: WO2020/204890
PCT Pub. Date: Oct. 8, 2020

(65) Prior Publication Data

US 2022/0127912 A1 Apr. 28, 2022

(51) Int. Cl.
*E21B 43/119* (2006.01)
*E21B 17/042* (2006.01)
*E21B 43/117* (2006.01)

(52) U.S. Cl.
CPC ..... *E21B 43/119* (2013.01); *E21B 17/042* (2013.01); *E21B 43/117* (2013.01)

(58) Field of Classification Search
CPC ..... E21B 43/119; E21B 43/117; E21B 17/042
See application file for complete search history.

(56) References Cited

U.S. PATENT DOCUMENTS

| | | | | |
|---|---|---|---|---|
| 3,268,275 | A | 8/1966 | Laughlin | |
| 4,534,423 | A | 8/1985 | Regalbuto | |
| 6,006,833 | A * | 12/1999 | Burleson | E21B 43/117 166/250.01 |
| 2006/0090902 | A1 | 5/2006 | Costa et al. | |
| 2011/0000669 | A1* | 1/2011 | Barlow | E21B 43/12 166/63 |
| 2011/0017453 | A1 | 1/2011 | Mytopher et al. | |
| 2013/0126237 | A1* | 5/2013 | Burton | E21B 43/1185 175/2 |
| 2016/0061572 | A1* | 3/2016 | Eitschberger | F42C 19/12 29/592.1 |
| 2017/0211363 | A1* | 7/2017 | Bradley | F42B 5/035 |
| 2017/0314373 | A9 | 11/2017 | Bradley et al. | |
| 2021/0355797 | A1* | 11/2021 | Roberts | E21B 43/116 |
| 2022/0403718 | A1* | 12/2022 | Eitschberger | E21B 43/117 |

FOREIGN PATENT DOCUMENTS

| | | | |
|---|---|---|---|
| CN | 201891408 | U | 7/2011 |
| WO | WO2018026952 | A1 | 2/2018 |

* cited by examiner

*Primary Examiner* — Theodore N Yao
(74) *Attorney, Agent, or Firm* — John Wustenberg; Parker Justiss, P.C.

(57) ABSTRACT

Provided is a perforating gun assembly for use in a wellbore. In one aspect, the perforating gun assembly includes at least a tubular carrier gun body having an outer diameter, an inner diameter, and a threaded portion extending a distance (d) along an outer surface and proximate an uphole end thereof; and a swell sleeve located radially inside of the tubular carrier gun body, the swell sleeve extending along at least 90% of the distance (d).

26 Claims, 5 Drawing Sheets

SLEEVED GUN CONNECTION

CROSS-REFERENCE TO RELATED APPLICATION

This application is the National Stage of, and therefore claims the benefit of, International Application No. PCT/US2019/024969 filed on Mar. 29, 2019, entitled "SLEEVED GUN CONNECTION," which was published in English under International Publication Number WO 2020/204890A1 on Oct. 8, 2020. The above application is commonly assigned with this National Stage application and is incorporated herein by reference in its entirety.

BACKGROUND

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement and a short distance into the formation.

Typically, these perforations are created by detonating a series of shaped charges that are disposed within the casing string and are positioned adjacent to the formation. Specifically, one or more perforating guns are loaded with shaped charges that are connected with a detonator via a detonation cord. The perforating guns are then connected within a tool string that is lowered into the cased wellbore at the end of a tubing string, wireline, slick line, coil tubing or other conveyance. Once the perforating guns are properly positioned in the wellbore such that the shaped charges are adjacent to the formation to be perforated, the shaped charges may be detonated, thereby creating the desired openings.

Once the desired openings have been formed, the tool string including the perforating gun may be withdrawn uphole. While the perforating gun itself may not be reused, it is desirable to reuse the tool string and sub-assembly holding the perforating gun, as well as desirable to easily and safely disassemble the perforating gun for disposal thereof. Thus, improvements are needed in the art to more easily and/or consistently reuse the tool string and sub-assembly holding the perforating gun after retrieval thereof.

BRIEF DESCRIPTION

Reference is now made to the following descriptions taken in conjunction with the accompanying drawings, in which.

DETAILED DESCRIPTION

Figure 1:
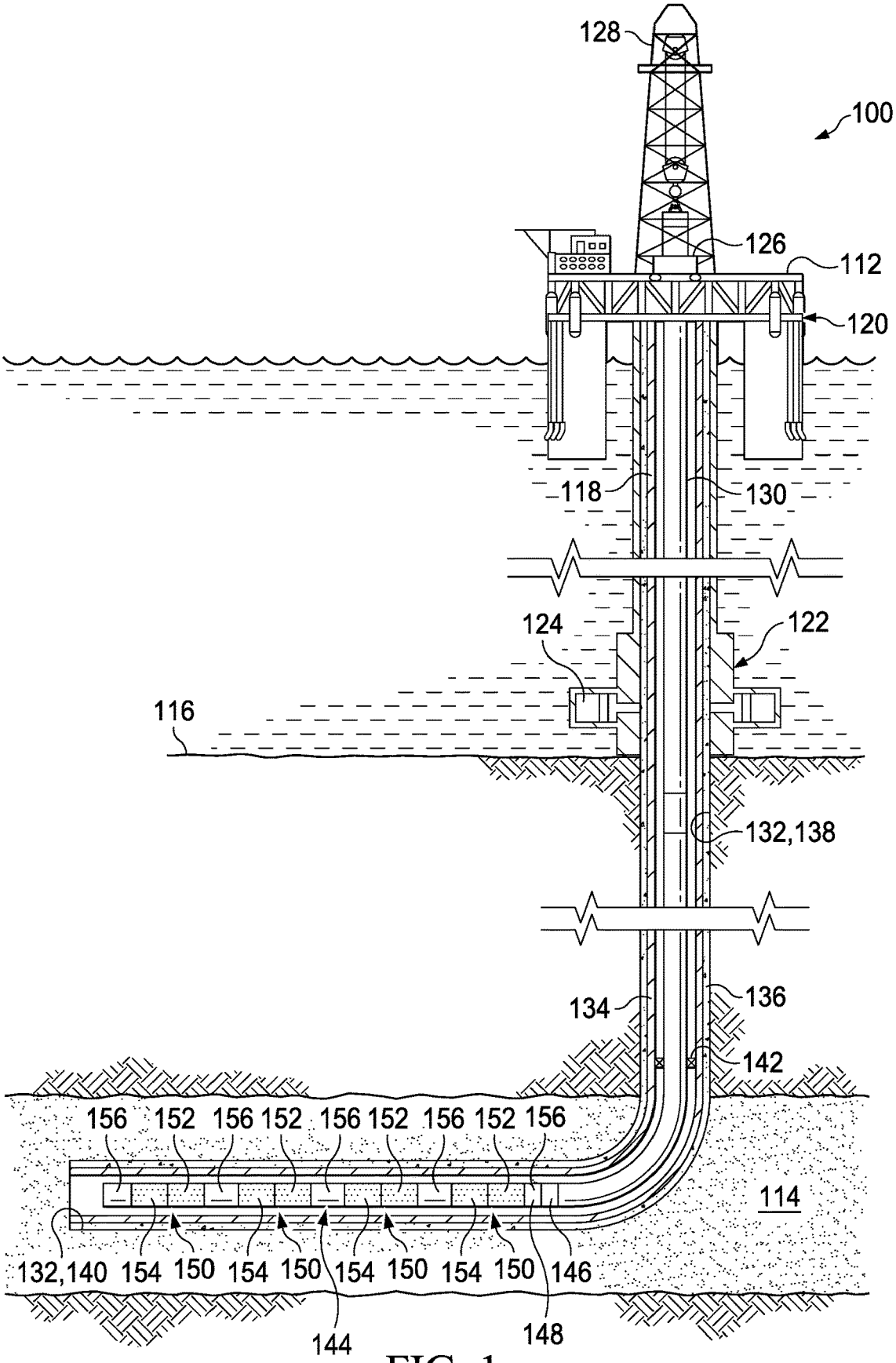
FIG. 1 is a schematic illustration of a well system including a plurality of perforating gun assemblies of the present disclosure operating in a subterranean formation.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Referring initially to FIG. 1, schematically illustrated is a well system 100 including a plurality of perforating gun assemblies of the present disclosure operating in a subterranean formation (e.g., from an offshore oil and gas platform). A semi-submersible platform 112 is positioned over a submerged oil and gas formation 114 located below sea floor 116. A subsea conduit 118 extends from deck 120 of platform 112 to wellhead installation 122 including subsea blow-out preventers 124. Platform 112 has a hoisting apparatus 126 and a derrick 128 for raising and lowering pipe strings such as work string 130. As used herein, work string encompasses any conveyance for downhole use, including drill strings, completion strings, evaluation strings, other tubular members, wireline systems, and the like.

A wellbore 132 extends through the various earth strata including formation 114. In the embodiment of FIG. 1, a casing 134 is cemented within wellbore 132 by cement 136. Work string 130 includes various tools such as a plurality of perforating gun assemblies of the present disclosure. When it is desired to perforate formation 114, work string 130 is lowered through casing 134 until the perforating guns are properly positioned relative to formation 114. Thereafter, the shaped charges within the string of perforating guns may be sequentially fired, either in an uphole to downhole or a downhole to uphole direction. Upon detonation, the liners of the shaped charges form jets that create a spaced series of perforations extending outwardly through casing 134, cement 136 and into formation 114, thereby allowing fluid communication between formation 114 and wellbore 132. In accordance with one embodiment of the disclosure, a swell sleeve may be employed radially inside of a threaded connection of the carrier gun body. Specifics of the swell sleeve will be discussed in greater detail below.

In the illustrated embodiment, wellbore 132 has an initial, generally vertical portion 138 and a lower, generally deviated portion 140 which is illustrated as being horizontal. It should be noted, however, by those skilled in the art that the perforating gun assemblies of the present disclosure are equally well-suited for use in other well configurations including, but not limited to, inclined wells, wells with restrictions, non-deviated wells and the like.

In the embodiment of FIG. 1, work string 130 includes a retrievable packer 142 which may be sealingly engaged with casing 134 in a vertical portion 138 of wellbore 132. At the lower end of work string is a gun string, generally designated 144. In the illustrated embodiment, gun string 144 has at its upper or near end a ported nipple 146 below which is a time domain firer 148. Time domain firer 148 is disposed at the upper end of a tandem gun set 150 including first and second guns 152 and 154. In the illustrated embodiment, a plurality of such gun sets 150, each including a first gun 152 and a second gun 154 are utilized. Positioned between each gun set 150 in the embodiment of FIG. 1 is a blank pipe section 156. Blank pipe sections 156 may be used to control and optimize the pressure conditions in wellbore 132 immediately after detonation of the shaped charges. While tandem gun sets 150 have been described with blank pipe sections 156 there between, it should be understood by those skilled in the art that any arrangement of perforating guns may be utilized in conjunction with the present disclosure including both more or less sections of blank pipe as well as no sections of blank pipe, without departing from the principles of the present disclosure.

Figure 2:
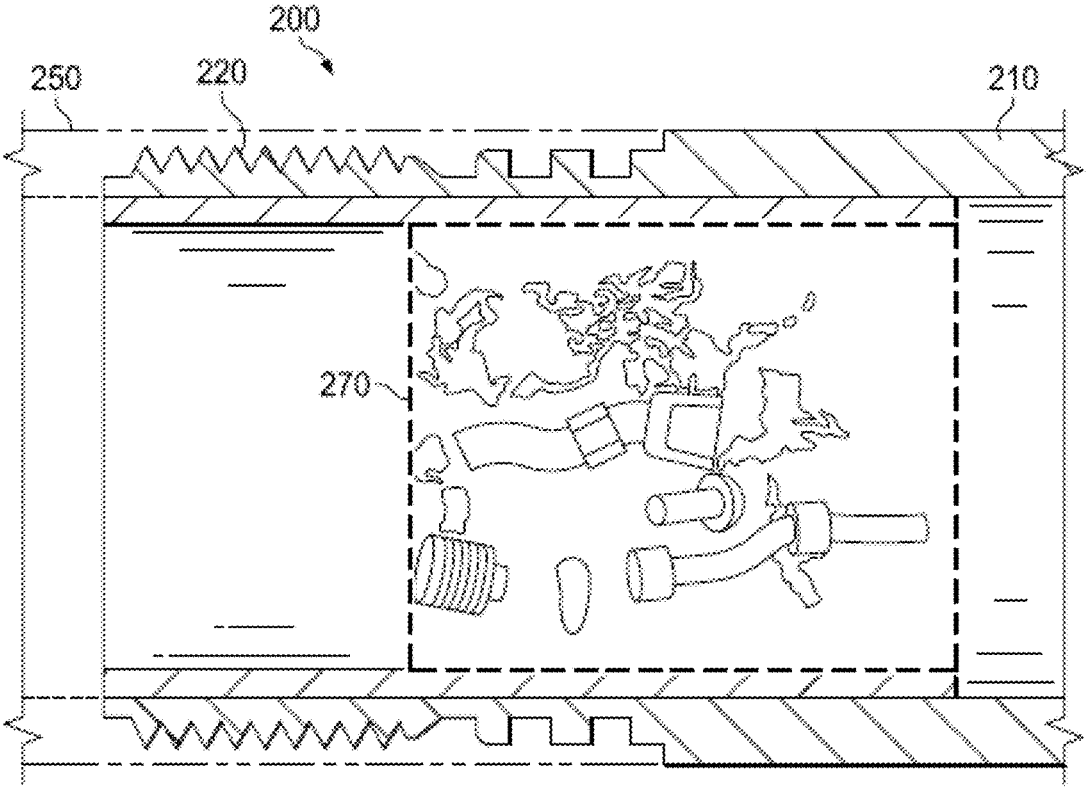
FIG. 2 is a side view showing debris that may occur within a perforating gun assembly of the present disclosure.

The present disclosure has acknowledged that on perforating gun assemblies having threaded connections coupling the carrier gun body to a deployment sub-assembly, upon detonation, debris inside the carrier gun body (e.g., from the detonator, charges, charge tube, end alignment, etc.) can form a plug at the connection causing the threaded connection to swell, locking the threads together. This can make the guns difficult or impossible to break apart when pulled out of hole. This can also cause the gun to get stuck to subs and crossovers, or damage their threads beyond use. Turning briefly to FIG. 2, illustrated is a computed tomography ("CT") scan of a perforating gun assembly 200 where a carrier gun body 210 is stuck to a deployment sub-assembly 250, for example as a result of the debris 270 inside the gun body 210 causing the threaded connection to swell. Based upon the foregoing, the present disclosure has newly recognized that the inclusion of a swell sleeve radially inside of the carrier gun body proximate the threaded connection may reduce (e.g., eliminate) the swelling of the threaded connection, and thus the sticking issue discussed above.

Figure 3:
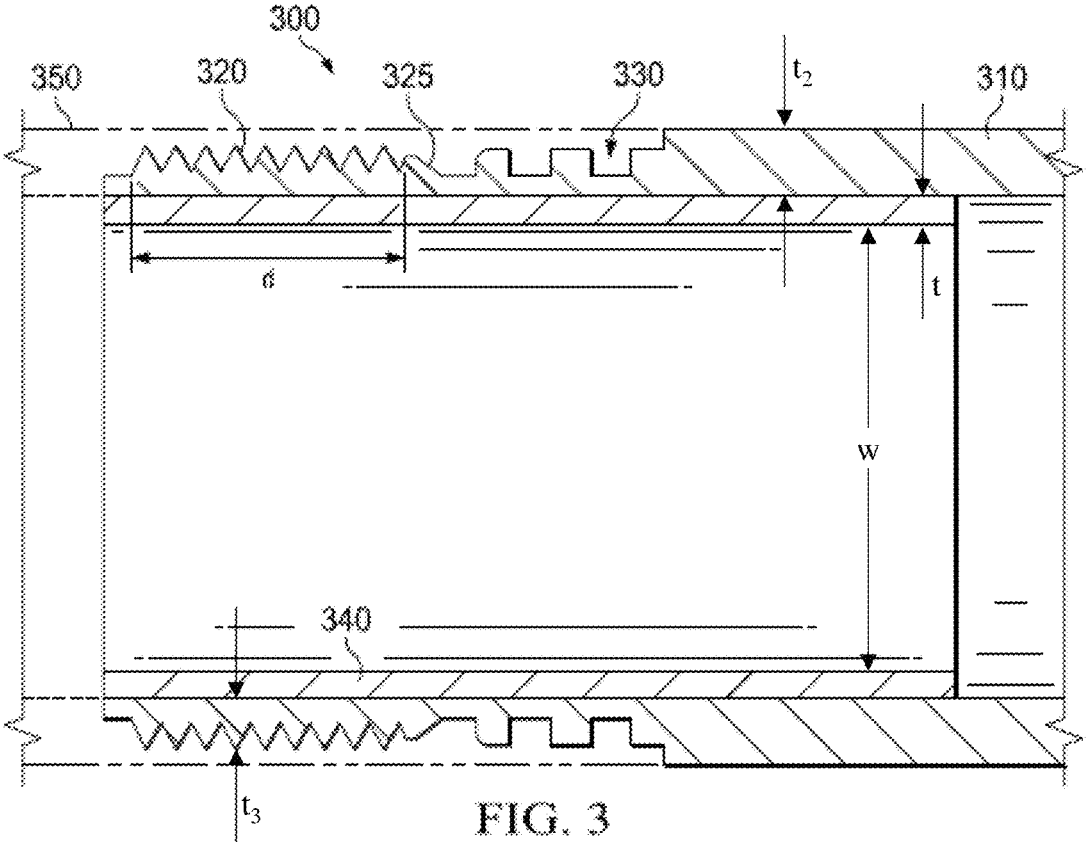
FIG. 3 is a side view of one embodiment of a perforating gun assembly according to the present disclosure.

Referring now to FIG. 3 there is shown one embodiment of a perforating gun assembly 300 according to the disclosure. The perforating gun assembly 300 includes at least a tubular carrier gun body 310 having an outer diameter and an inner diameter. The carrier gun body 310 may include a threaded portion 320 extending a distance (d) along an outer surface of the carrier gun body 310 and proximate an uphole end thereof. The threaded portion 320 may include a thread relief 325 at one end thereof. The carrier gun body 310, in this embodiment, may include one or more grooves 330 in the outer surface for receiving seals, such as, e.g. o-rings, therein. In this embodiment, the one or more grooves 330 may be adjacent the thread relief 325.

A swell sleeve 340 may be located radially inside of the carrier gun body 310. In this embodiment, the swell sleeve 340 may extend along at least 90% of the distance (d) of the threaded portion 320. In the particular embodiment of FIG. 3, an uphole end of the swell sleeve 340 is substantially aligned with an uphole end of the carrier gun body 310, and then the swell sleeve 340 extends downhole within the carrier gun body 310 past all of the threaded portion 320 and beyond the one or more grooves, before terminating above the shaped charges (not shown).

The swell sleeve 340 is configured to improve hoop strength of the carrier gun body 310 and specifically, the threaded portion 320, to reduce/prevent the threaded portion 320 from swelling radially outward due to debris within the carrier gun body 310 such that the carrier gun body 310 may be easily disconnected from a subassembly 350 positioned uphole of the carrier gun body 310. The swell sleeve 340 may comprise steel, aluminum, ceramics, and other materials which can better withstand the detonation of the charges downhole in the perforating gun assembly 300. In some embodiments, the swell sleeve 340 may have a sidewall thickness (t) of about 2.5 mm to about 13 mm. In one example, however, the sidewall thickness (t) of the swell sleeve could be chosen as a function of the yield strength of the material used and the sidewall thickness thereof. Thus, in one embodiment a ratio of yield strength (Kpsi) to sidewall thickness (mm) of at least about 40 Kpsi/mm might be desirable. As an example, for a material having a yield strength of 200 Kpsi, the sidewall thickness (t) should be at least about 0.2 mm. Conversely, if there was a desire to have a sidewall thickness (t) of about 2 mm, the material chosen should have a yield strength of at least about 20 Kpsi. In the illustrated embodiment, the sidewall thickness (t) of the swell sleeve 340 is less than a sidewall thickness (t2) of the carrier gun body 310. In the illustrated embodiment. the sidewall thickness (t) of the swell sleeve 340 is less than a sidewall thickness (t3) of the threaded portion 320. In the illustrated embodiment, the swell sleeve 340 is a non-threaded swell sleeve.

The swell sleeve 340 may be installed or held in place using a variety of different techniques and remain within the scope of the present disclosure. For example, the swell sleeve 340 may be press fit, welded, held in place with an adhesive or bonding agent, held in place with snap rings, etc. Moreover, the swell sleeve 340 may be installed after the perforating gun assembly 300 is loaded, and just prior to threading the perforating gun assembly 300 with the deployment sub-assembly. In this embodiment, the swell sleeve 340 may be held in place via interference between the carrier gun body 310 and the deployment sub-assembly.

Figure 4:
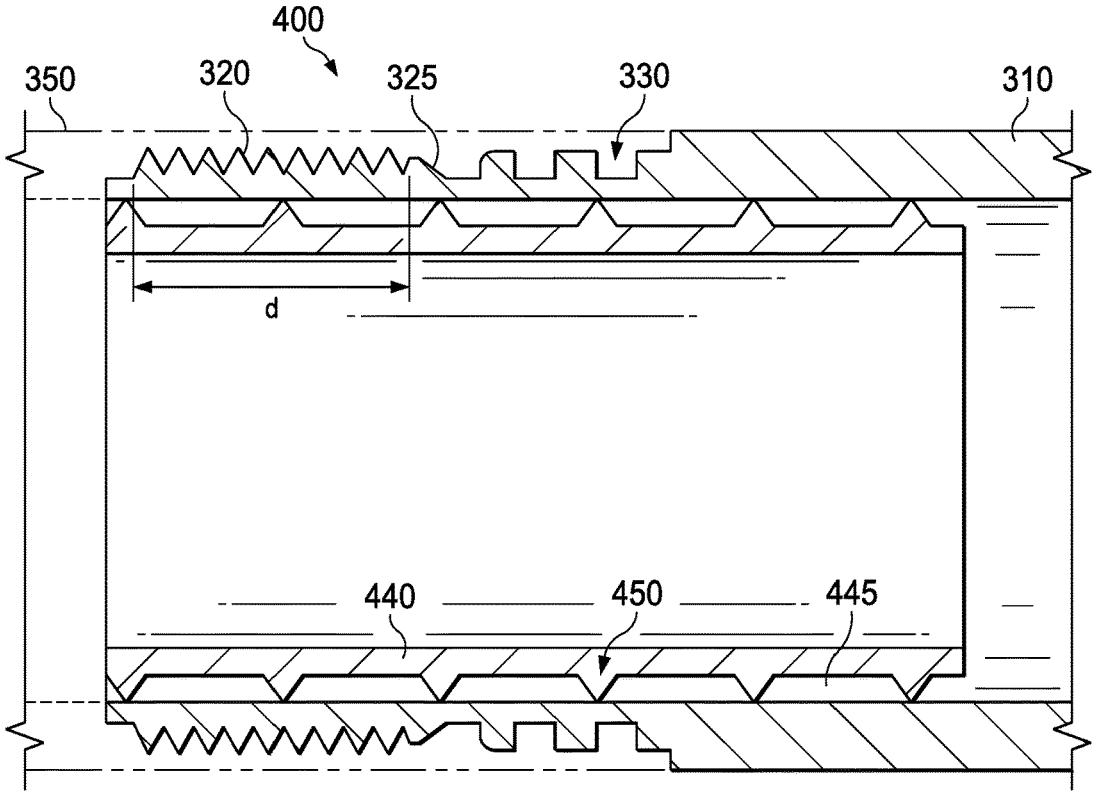
FIG. 4 is a side view of another embodiment of a perforating gun assembly according to the present disclosure.

Referring now to FIG. 4, there is shown another embodiment of a perforating gun assembly 400. A swell sleeve 440 may again be positioned radially inside the carrier gun body 310. In this embodiment, the swell sleeve 440 may be offset from the inner diameter of the carrier gun body 310 by a gap 445. The swell sleeve 440, in this embodiment, includes offsets 450 protruding radially outward into the gap 445 toward the inner diameter of the carrier gun body 310. The offsets 450, in the illustrated embodiment, define the gap 445, which may allow radial displacement of the swell sleeve 440 (e.g., providing a crumpling effect) during a post detonation dynamic event. The displacement may absorb energy to provide additional support against swelling of the threaded portion 320. While one particular embodiment has been illustrated with offsets 450 defining the gap 445, other gap creating mechanisms including bevels, grooves, bosses, etc. are within the scope of the present disclosure.

Figure 5:
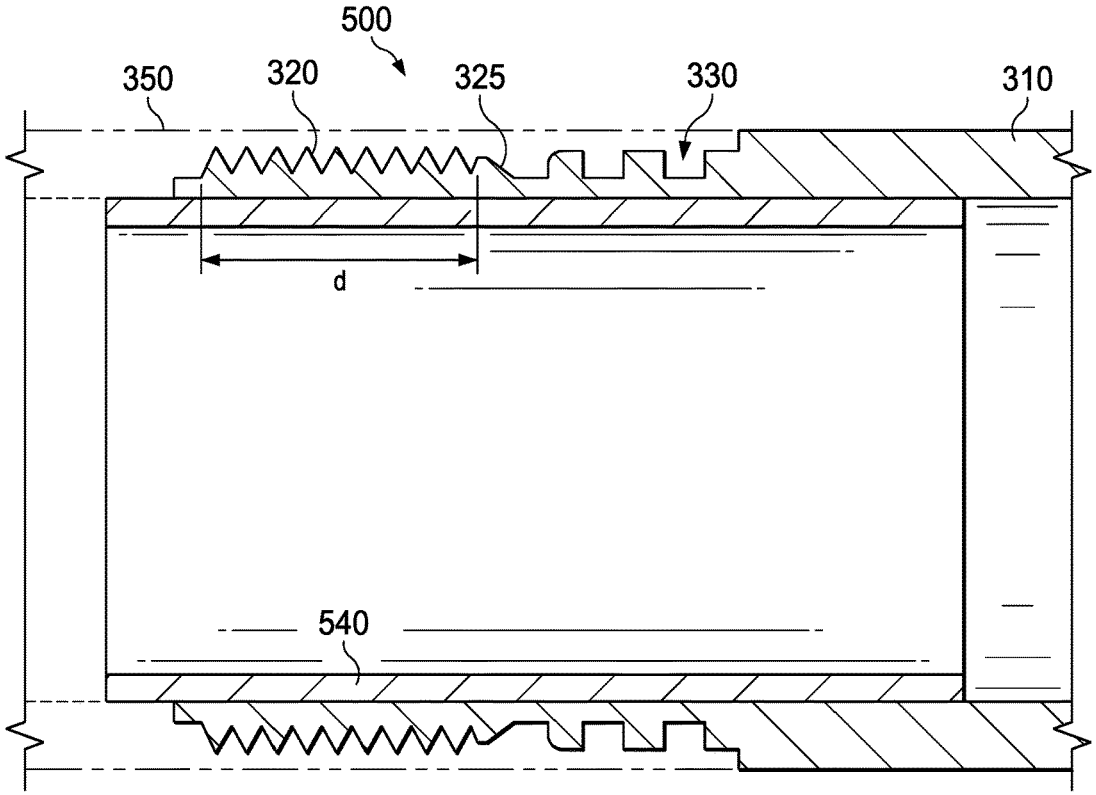
FIG. 5 is a side view of yet another embodiment of a perforating gun assembly according to the present disclosure.

Referring now to FIG. 5, there is shown another embodiment of a perforating gun assembly 500. The perforating gun assembly 500, in this embodiment, includes a swell sleeve 540, positioned radially inside the carrier gun body 310. The swell sleeve 540, in this embodiment, may extend outside the uphole end of the carrier gun body 310 a prescribed distance. The prescribed distance may vary based upon the need to reduce the aforementioned swelling of the threaded portion 320. For instance, in one embodiment the swell sleeve 540 might extend past the uphole end of the carrier gun body 310 by an amount of at least about 30 percent of the distance (d).

Figure 6:
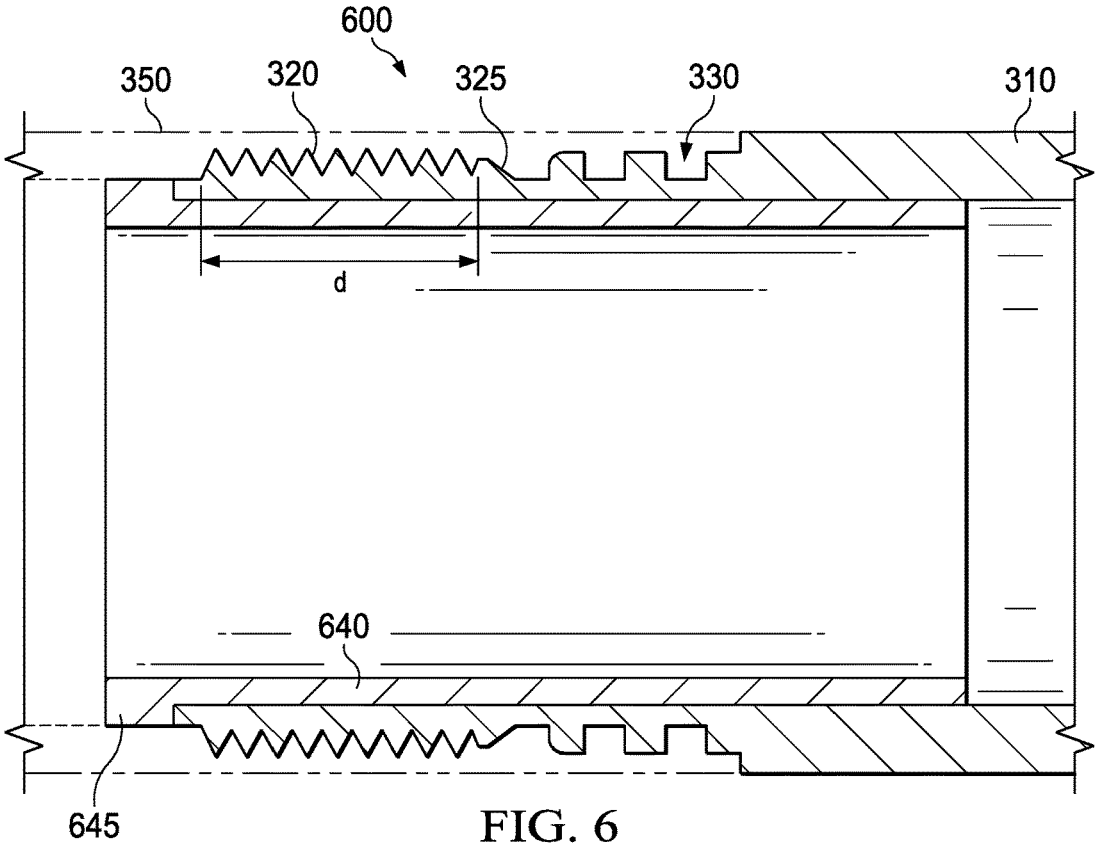
FIG. 6 is a side view of still another embodiment of a perforating gun assembly according to the present disclosure.

Referring now to FIG. 6, there is shown another embodiment of a perforating gun assembly 600. The perforating gun assembly 600, in this embodiment, includes a swell sleeve 640, positioned radially inside the carrier gun body 310. The swell sleeve 640, in this embodiment, may extend outside the uphole end of the carrier gun body 310 and include an outward protrusion such as a shoulder 645. The shoulder 645, in this embodiment, may be seated against the uphole end of the carrier gun body 310. Nevertheless, there may be some embodiments, where there may be a spacing or gap between the shoulder 645 and the uphole end of carrier gun body 310. The shoulder 645 may further protect the threaded portion 320 from debris (e.g., flowing debris) formed during detonation. The placement of the shoulder 645 may also allow the carrier gun body 310, in some embodiments, to be formed by various assembly methods, including, but not limited to shrink fitting, interference fitting, and press fitting.

Figure 7:
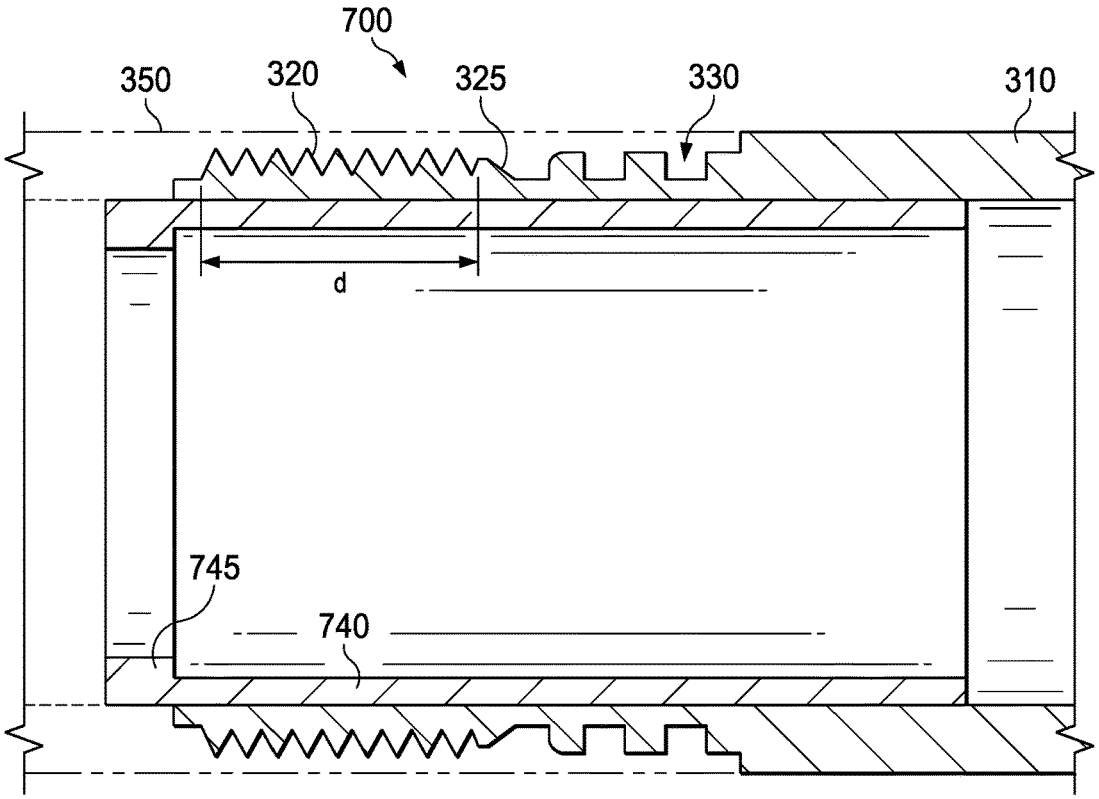
FIG. 7 is a side view of another embodiment of a perforating gun assembly according to the present disclosure.

Referring now to FIG. 7, there is shown yet another embodiment of a perforating gun assembly 700. The perforating gun assembly 700, in this embodiment, includes a swell sleeve 740, positioned radially inside the carrier gun body 310. The swell sleeve 740, in this embodiment, may include a radially inward protrusion such as interior shoulder 745. In this embodiment, the swell sleeve 740 extends outside the uphole end of the carrier gun body 310, but there may be some embodiments, where the swell sleeve 740 may not extend outside the uphole end of the carrier gun bod 310*y*. The interior shoulder 745, in some embodiments, may seat against a detonator sleeve (not shown) also positioned radially inside the carrier gun body. The interior shoulder 745 may provide additional protection for the threaded portion 320 by at least partially obstructing debris formed during detonation, thereby directing the material away from the threaded portion 320 and toward a radial center of the carrier gun body 310.

Figure 8:
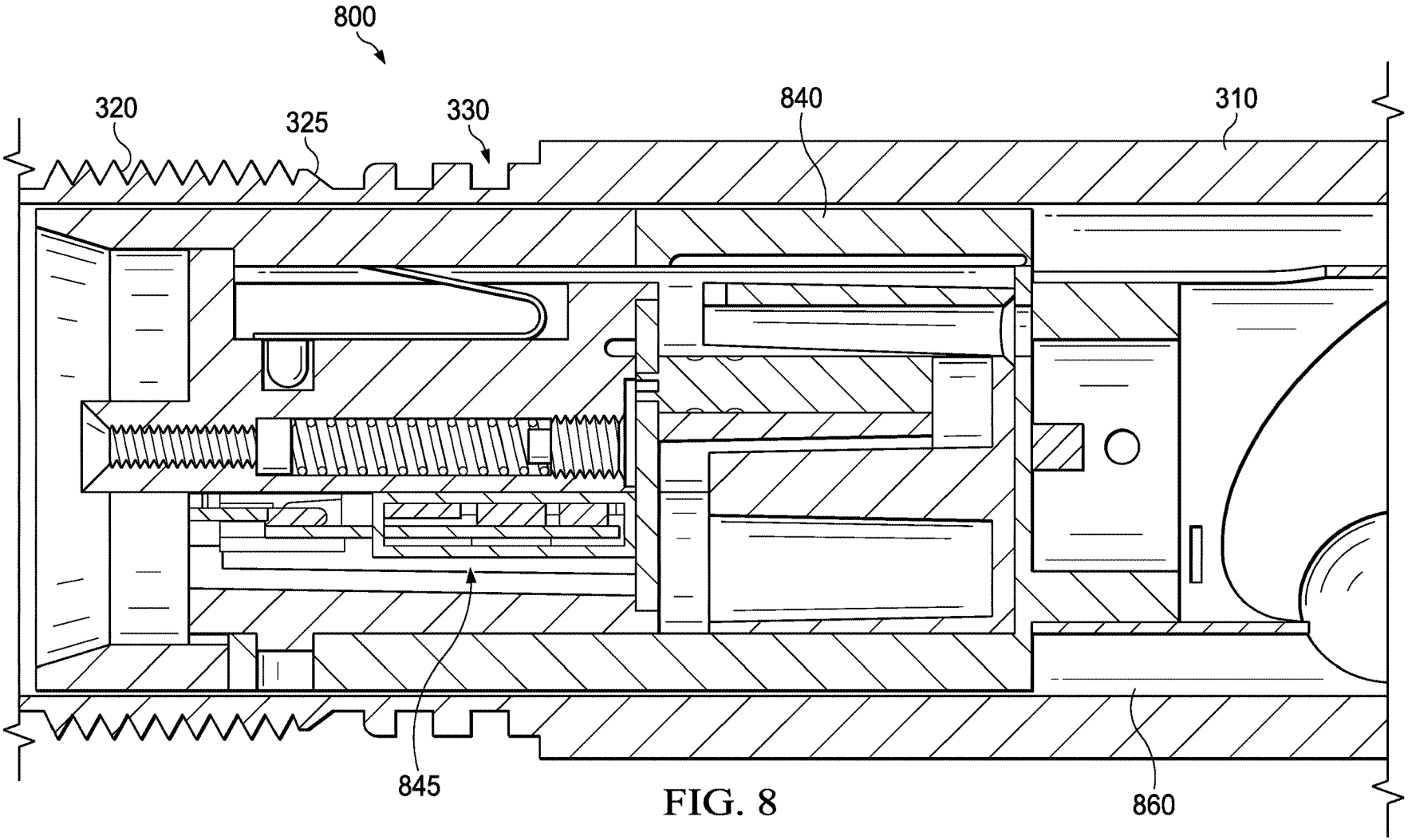
FIG. 8 is a side view of yet another embodiment of a perforating gun assembly according to the present disclosure.

Referring now to FIG. 8, there is shown still another embodiment of a perforating gun assembly 800. The perforating gun assembly 800 includes a swell sleeve 840 positioned radially inside the carrier gun body 310. In this embodiment, the swell sleeve 840 forms at least a part of a detonator sleeve and extends toward a charge tube 860 downhole within the carrier gun body 310. In this embodiment, a detonator assembly 845 may be positioned radially within the swell sleeve (e.g., the swell sleeve also functioning as a detonator sleeve) and positioned uphole of the charge tube. This dual function swell sleeve/detonator sleeve may provide a very reliable method for grounding the detonator of the perforating gun assembly 800.

Aspects disclosed herein include:

A. A perforating gun assembly for use in a wellbore, the perforating gun assembly comprising: a tubular carrier gun body having an outer diameter and an inner diameter, the tubular carrier gun body having a threaded portion extending a distance (d) along an outer surface and proximate an uphole end thereof; and a swell sleeve located radially inside of the tubular carrier gun body, the swell sleeve extending substantially along the distance (d).

B. A well system, comprising: a wellbore; and a perforating gun assembly positioned within the wellbore, the perforating gun assembly held in place by a conveyance and sub-assembly, and comprising: (1) a tubular carrier gun body having an outer diameter and an inner diameter, the carrier gun body having a threaded portion extending a distance (d) along an outer surface and proximate an uphole end thereof, the threaded portion configured to form a threaded connection with the sub-assembly; (2) a swell sleeve located radially inside of the tubular carrier gun body, the swell sleeve extending substantially along the distance (d); and (3) a plurality of shaped charges supported within the tubular carrier gun body.

C. A method for perforating a wellbore, comprising: positioning a perforating gun assembly at a desired location within a wellbore, the perforating gun assembly including; (1) a tubular carrier gun body having an outer diameter and an inner diameter, the carrier gun body having a threaded portion extending a distance (d) along an outer surface and proximate an uphole end thereof, the threaded portion configured to form a threaded connection with a sub-assembly deploying the perforating gun assembly; (2) a swell sleeve located radially inside of the tubular carrier gun body, the swell sleeve extending substantially along the distance (d); and (3) a plurality of shaped charges supported within the tubular carrier gun body; and detonating explosive material within the plurality of shaped charges to form a plurality of jets that penetrate the wellbore and form a plurality of openings therein.

Aspects A, B, and C may have one or more of the following additional elements in combination: Element 1: wherein the swell sleeve extends outside the uphole end of the carrier gun body. Element 2: wherein the swell sleeve includes a radially outward protrusion. Element 3: wherein the swell sleeve includes a radially inward protrusion. Element 4: wherein the swell sleeve is offset from the inner diameter of the carrier gun body by a gap, wherein the swell sleeve includes a plurality of offsets which protrude radially outward toward the inner diameter of the carrier gun body. Element 5: wherein the swell sleeve forms at least a portion of a detonator sleeve. Element 6: further including a detonator assembly positioned radially within the swell sleeve.

Those skilled in the art to which this application relates will appreciate that other and further additions, deletions, substitutions and modifications may be made to the described embodiments.

What is claimed is:

1. A perforating gun assembly for use in a wellbore, the perforating gun assembly comprising:

a tubular carrier gun body having an outer diameter, an inner diameter, and a threaded portion extending a distance (d) along an outer surface and proximate an uphole end thereof; and a swell sleeve located radially inside of the tubular carrier gun body, the swell sleeve extending along at least 90% of the distance (d), and further wherein the swell sleeve is a non-threaded swell sleeve, wherein a material used for the swell sleeve has a yield strength, and further wherein a ratio of the yield strength to sidewall thickness (t) is at least 40 Kpsi/mm.

2. The perforating gun assembly according to claim 1, wherein the swell sleeve extends outside the uphole end of the carrier gun body.

3. The perforating gun assembly according to claim 2, wherein the swell sleeve includes a radially outward protrusion.

4. The perforating gun assembly according to claim 1, wherein the swell sleeve includes a radially inward protrusion.

5. The perforating gun assembly according to claim 1, wherein the swell sleeve is offset from the inner diameter of the carrier gun body by a gap, wherein the swell sleeve includes a plurality of offsets which protrude radially outward toward the inner diameter of the carrier gun body.

6. The perforating gun assembly according to claim 1, wherein the swell sleeve forms at least a portion of a detonator sleeve.

7. The perforating gun assembly according to claim 6, further including a detonator assembly positioned radially within the swell sleeve.

8. The perforating gun assembly according to claim 1, wherein the sidewall thickness (t) ranges from 2.5 mm to 13 mm.

9. The perforating gun assembly according to claim 1, wherein the sidewall thickness (t) of the swell sleeve is less than a sidewall thickness ($t_3$) of the threaded portion.

10. A well system, comprising:

a wellbore; and a perforating gun assembly positioned within the wellbore, the perforating gun assembly held in place by a conveyance and sub-assembly, and comprising:

a tubular carrier gun body having an outer diameter, an inner diameter, and a threaded portion extending a distance (d) along an outer surface and proximate an uphole end thereof, the threaded portion configured to form a threaded connection with the sub-assembly;

a swell sleeve located radially inside of the tubular carrier gun body, the swell sleeve extending along at least 90% of the distance (d), and further wherein the swell sleeve is a non-threaded swell sleeve, wherein a material used for the swell sleeve has a yield strength, and further wherein a ratio of the yield strength to sidewall thickness (t) is at least 40 Kpsi/mm; and a plurality of shaped charges supported within the tubular carrier gun body.

11. The well system according to claim 10, wherein the swell sleeve extends outside the uphole end of the carrier gun body.

12. The well system according to claim 11, wherein the swell sleeve includes a radially outward protrusion.

13. The well system according to claim 10, wherein the swell sleeve includes a radially inward protrusion.

14. The well system according to claim 10, wherein the swell sleeve is offset from the inner diameter of the carrier gun body by a gap, wherein the swell sleeve includes a plurality of offsets which protrude radially outward toward the inner diameter of the carrier gun body.

15. The well system according to claim 10, wherein the swell sleeve forms at least a portion of a detonator sleeve.

16. The well system according to claim 15, further including a detonator assembly positioned radially within the swell sleeve.

17. The well system according to claim 10, wherein the sidewall thickness (t) ranges from 2.5 mm to 13 mm.

18. The well system according to claim 10, wherein the sidewall thickness (t) of the swell sleeve is less than a sidewall thickness ($t_3$) of the threaded portion.

19. A method for perforating a wellbore, comprising:

positioning a perforating gun assembly at a desired location within a wellbore, the perforating gun assembly including;

a tubular carrier gun body having an outer diameter, an inner diameter, and a threaded portion extending a distance (d) along an outer surface and proximate an uphole end thereof, the threaded portion configured to form a threaded connection with a sub-assembly deploying the perforating gun assembly;

a swell sleeve located radially inside of the tubular carrier gun body, the swell sleeve extending along at least 90% of the distance (d), and further wherein the swell sleeve is a non-threaded swell sleeve, wherein a material used for the swell sleeve has a yield strength, and further wherein a ratio of the yield strength to sidewall thickness (t) is at least 40 Kpsi/mm; and a plurality of shaped charges supported within the tubular carrier gun body; and detonating explosive material within the plurality of shaped charges to form a plurality of jets that penetrate the wellbore and form a plurality of openings therein.

20. The method for perforating a wellbore according to claim 19, wherein the swell sleeve extends outside the uphole end of the carrier gun body.

21. The method for perforating a wellbore according to claim 20, wherein the swell sleeve includes a radially outward protrusion.

22. The method for perforating a wellbore according to claim 19, wherein the swell sleeve includes a radially inward protrusion.

23. The method for perforating a wellbore according to claim 19, wherein the swell sleeve is offset from the inner diameter of the carrier gun body by a gap, wherein the swell sleeve includes a plurality of offsets which protrude radially outward toward the inner diameter of the carrier gun body.

24. The method for perforating a wellbore according to claim 19, wherein the swell sleeve forms at least a portion of a detonator sleeve.

25. The method according to claim 19, wherein the sidewall thickness (t) ranges from 2.5 mm to 13 mm.

26. A perforating gun assembly for use in a wellbore, the perforating gun assembly comprising:

a tubular carrier gun body having an outer diameter, an inner diameter, and a threaded portion extending a distance (d) along an outer surface and proximate an uphole end thereof; and a swell sleeve located radially inside of the tubular carrier gun body, the swell sleeve extending along at least 90% of the distance (d), wherein a material used for the swell sleeve has a yield strength (Kpsi), and further wherein a ratio of the yield strength to the sidewall thickness (t) is at least 40 Kpsi/mm.

* * * * *